US011377315B1

(12) United States Patent
Oshida

(10) Patent No.: US 11,377,315 B1
(45) Date of Patent: Jul. 5, 2022

(54) IMAGE PROCESSING APPARATUS

(71) Applicant: TOSHIBA TEC KABUSHIKI KAISHA, Tokyo (JP)

(72) Inventor: Katsuya Oshida, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/193,143

(22) Filed: Mar. 5, 2021

(51) Int. Cl.
*B65H 1/26* (2006.01)

(52) U.S. Cl.
CPC ..... *B65H 1/266* (2013.01); *B65H 2405/31* (2013.01)

(58) Field of Classification Search
CPC .. B65H 1/266; B65H 5/062; B65H 2402/441; B65H 2402/542; B65H 2402/22; B65H 2405/324; B65H 2403/531; B65H 2404/6111; G03G 15/6502; G03G 2215/00544; Y10T 292/696; Y10T 292/691
USPC ..... 271/164; 292/340; 399/393
See application file for complete search history.

(56) References Cited

U.S. PATENT DOCUMENTS 8,428,506 B2 * 4/2013 Miki ..... B65H 1/266 399/393
10,437,191 B2 * 10/2019 Kwon ..... G03G 15/6502
2006/0180996 A1 * 8/2006 Iwase ..... G03G 15/6502 271/162
2010/0007081 A1 1/2010 Miki
2013/0032996 A1 * 2/2013 Kubota ..... B65H 1/266 271/264
2013/0136491 A1 * 5/2013 Fumoto ..... G03G 21/1623 399/110
2013/0285317 A1 * 10/2013 Ishikura ..... B65H 1/266 271/241

FOREIGN PATENT DOCUMENTS

EP 2966015 A1 * 1/2016 ..... B65H 1/266
EP 3736637 A1 * 11/2020 ..... G03G 21/1623
JP 2008254841 A * 10/2008

* cited by examiner

*Primary Examiner* — Gregory W Adams
(74) *Attorney, Agent, or Firm* — Amin, Turocy & Watson LLP

(57) ABSTRACT

According to one embodiment, the image processing apparatus includes an apparatus main body, a sheet feed cassette, a pull-in member, and a biasing member. The sheet feed cassette is provided to be insertable into the apparatus main body. The pull-in member pushes the sheet feed cassette from a pull-in start position to a pull-in complete position to pull in the sheet feed cassette to the apparatus main body. The biasing member biases the pull-in member in the insertion direction. The biasing force of the biasing member in the state where the pull-in member is at a first position closer to the pull-in complete position than the pull-in start position is larger than the biasing force of the biasing member in the state where the pull-in member is at a second position closer to the pull-in start position than the first position.

20 Claims, 5 Drawing Sheets

IMAGE PROCESSING APPARATUS

FIELD

Embodiments described herein relate generally to an image processing apparatus, a sheet feed cassette operating mechanism, and methods related thereto.

BACKGROUND

An image processing apparatus that forms an image on a sheet or erases an image formed on a sheet includes a sheet feed cassette that stores sheets. The sheet feed cassette is detachable from the apparatus main body. The sheet feed cassette is pulled into the apparatus main body by an automatic pull-in mechanism. The pulling-in force of the automatic pulling-in mechanism may be the strongest at the start of pulling-in. In this case, when the sheet feed cassette is manually pulled out, a load is applied to the user and the sheet feed cassette may not be pulled out smoothly. On the other hand, when the pulling-in force of the automatic pulling-in mechanism at the start of pulling-in is set small, the sheet feed cassette may not be pulled in completely.

DETAILED DESCRIPTION

Figure 1:
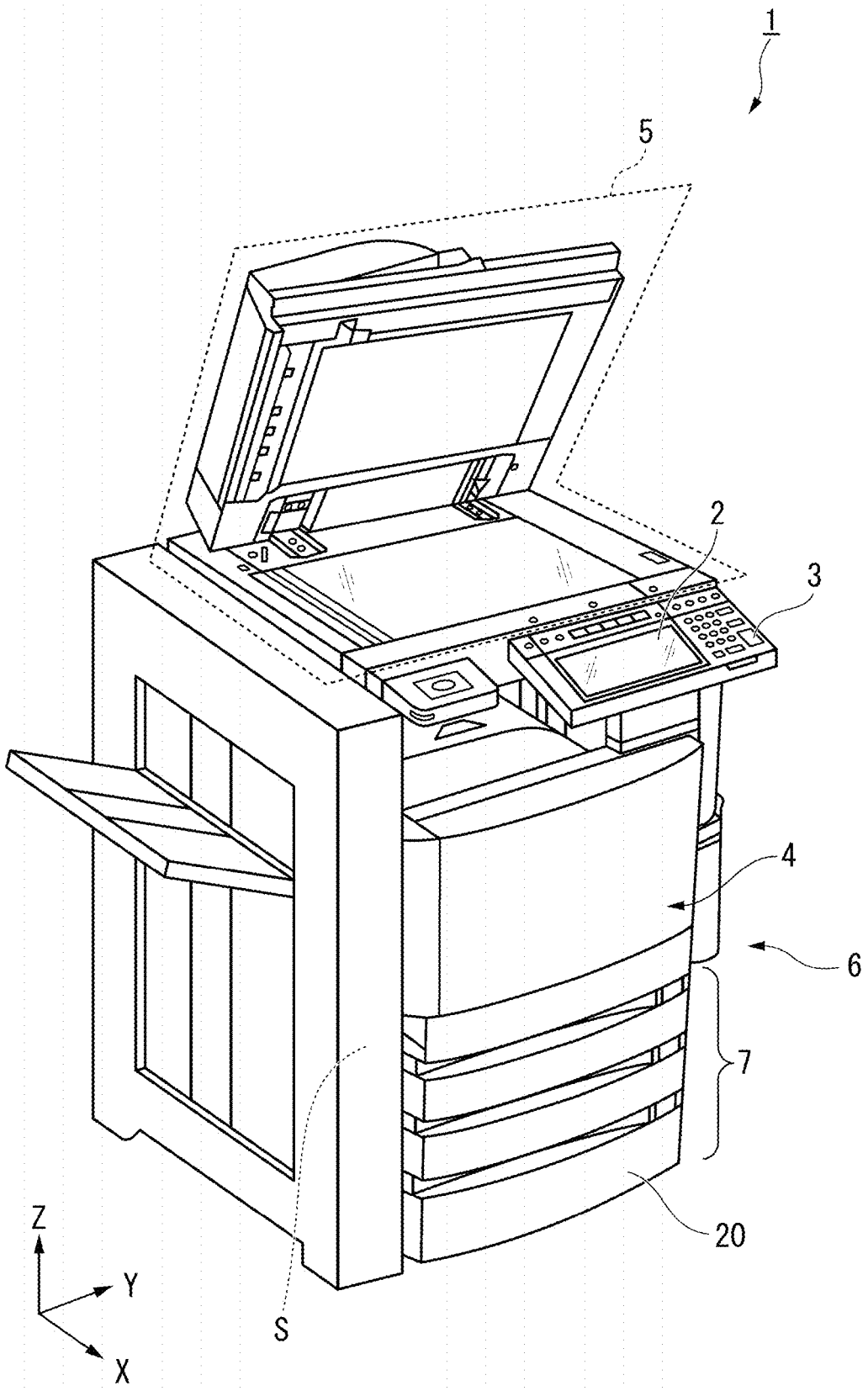
FIG. 1 is a perspective view of an image processing apparatus according to an embodiment.

In general, according to one embodiment, the image processing apparatus includes an apparatus main body, a sheet feed cassette, a pull-in member, and a biasing member. The sheet feed cassette is provided to be insertable into the apparatus main body. The pull-in member presses the sheet feed cassette from a pull-in start position to a pull-in complete position to pull in the sheet feed cassette to the apparatus main body. The biasing member biases the pull-in member in an insertion direction. The biasing force of the biasing member in the state where the pull-in member is at a first position closer to the pull-in complete position than the pull-in start position is larger than the biasing force of the biasing member in the state where the pull-in member is at a second position closer to the pull-in start position than the first position. According to another embodiment, a method of operating an image processing apparatus involving pulling, using a pull-in member, in a sheet feed cassette into an apparatus main body of the image processing apparatus from a pull-in start position to a pull-in complete position; and biasing the pull-in member in an insertion direction, wherein a biasing force in a state where the pull-in member is at a first position closer to the pull-in complete position than the pull-in start position is larger than a biasing force in a state where the pull-in member is at a second position closer to the pull-in start position than the first position.

Hereinafter, the image processing apparatus according to the embodiment will be described with reference to the drawings.

In the following description, a depth direction is set as an X-axis direction. A left-right direction is set as a Y-axis direction. A vertical direction is set as a Z-axis direction. The depth direction, the left-right direction, and the vertical direction are perpendicular to each other. In the drawing, an arrow X direction is the front side, and the opposite of the arrow X direction is the back side. In the drawing, an arrow Y direction is on the right side, and the opposite of the arrow X direction is on the left side. In the drawing, an arrow Z direction is on the upper side, and the opposite of the arrow Z direction is the lower side.

FIG. 1 is a perspective view of an image processing apparatus 1 according to the embodiment. The image processing apparatus 1 according to the embodiment is, for example, an image forming apparatus such as a multifunction printer (MFP) or a copying machine. In the following, an example of the case where the image processing apparatus 1 is the image forming apparatus as illustrated in FIG. 1 will be described.

As illustrated in FIG. 1, the image processing apparatus 1 includes a display 2, a control panel unit 3, an image forming unit 4, an image reading unit 5, an apparatus main body 6, and a sheet storage unit 7. The display 2 and the control panel unit 3 are used when the user operates the image processing apparatus 1. The image forming unit 4 forms an image on a sheet. The image reading unit 5 converts characters and images printed on a sheet into electronic data.

The apparatus main body 6 is a housing in which the display 2, the control panel unit 3, the image forming unit 4, the image reading unit 5, and the sheet storage unit 7 are built-in. The apparatus main body 6 is built-in with the sheet storage unit 7 in a lower space S. The sheet storage unit 7 includes a sheet feed cassette 20.

Figure 2:
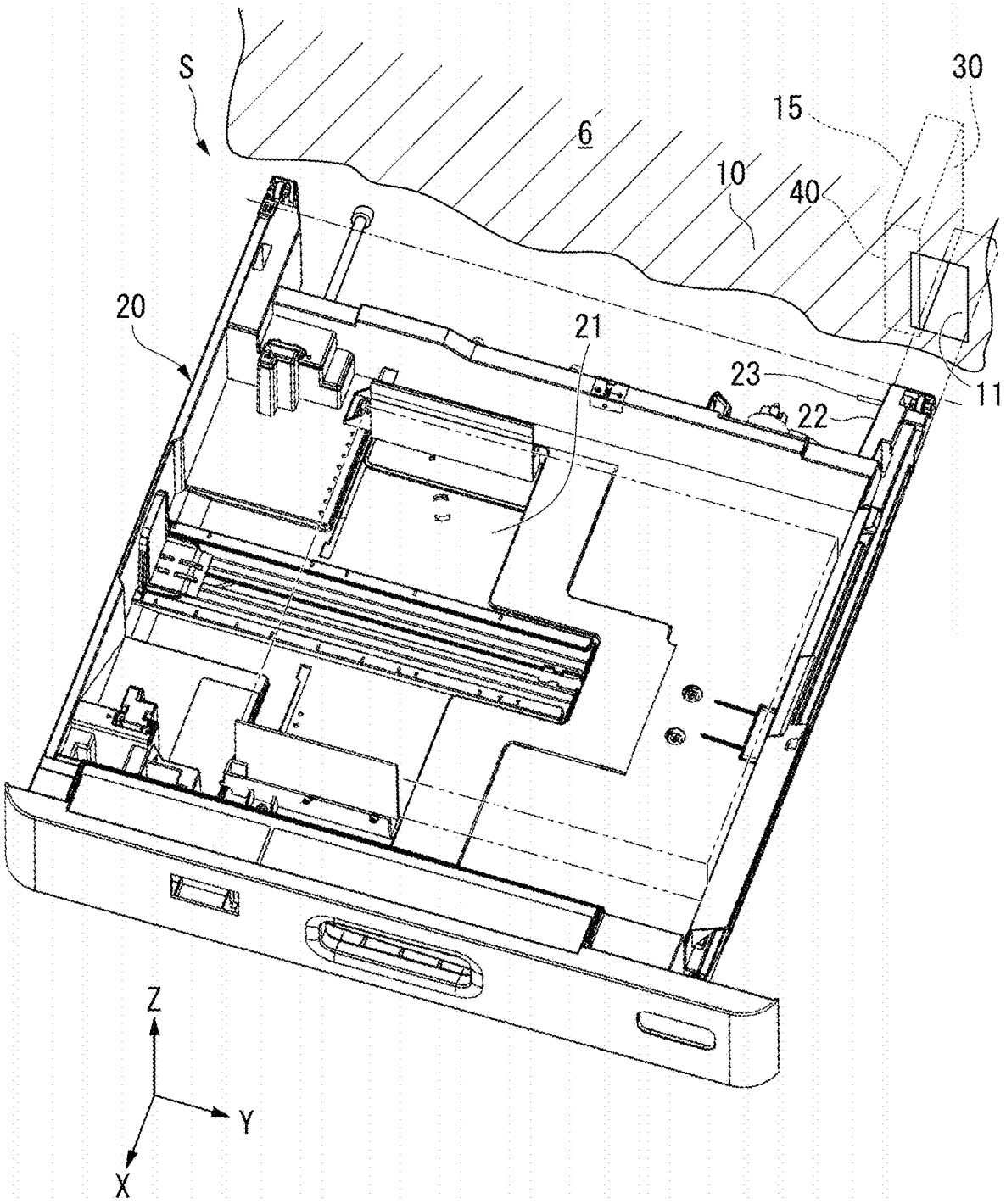
FIG. 2 is a perspective view illustrating a lower space S of the apparatus main body of the embodiment.

FIG. 2 is a perspective view illustrating the lower space S of the apparatus main body 6 of the embodiment. In FIG. 2, the description of the sheet feed cassette 20 constituting the sheet storage unit 7 is omitted except for one.

As illustrated in FIG. 2, the apparatus main body 6 includes an inner side surface 10 and a pull-in mechanism 15. The inner side surface 10 is a surface of the inner side of the apparatus main body 6. The inner side surface 10 faces the near side in the depth direction. The inner side surface 10 faces the lower space S. An introduction hole 11 is formed on the inner side surface 10. The introduction hole 11 penetrates the inner side surface 10 and has a substantially rectangular shape as viewed from the front. The introduction hole 11 allows a portion of the sheet feed cassette 20 to pass when the sheet feed cassette 20 is inserted into the apparatus main body 6.

The pull-in mechanism 15 pulls the sheet feed cassette 20 into the space S. The pull-in mechanism 15 applies a force inserted into the apparatus main body 6 to the sheet feed cassette 20. The pull-in mechanism 15 is connected to the back side of the inner side surface 10 of the apparatus main body 6.

Figure 3:
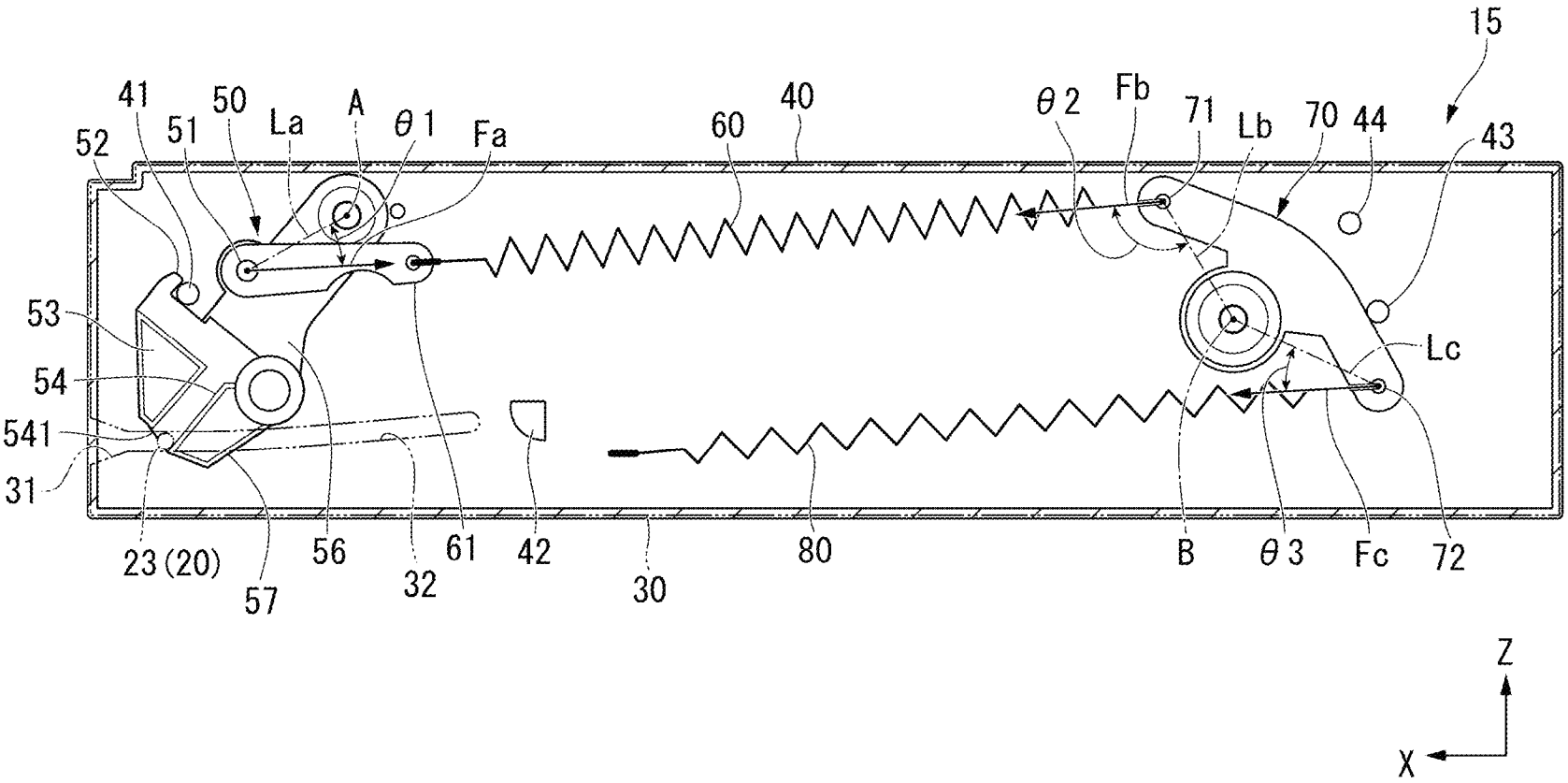
FIG. 3 is a side view illustrating the pull-in mechanism of the embodiment.
Figure 4:
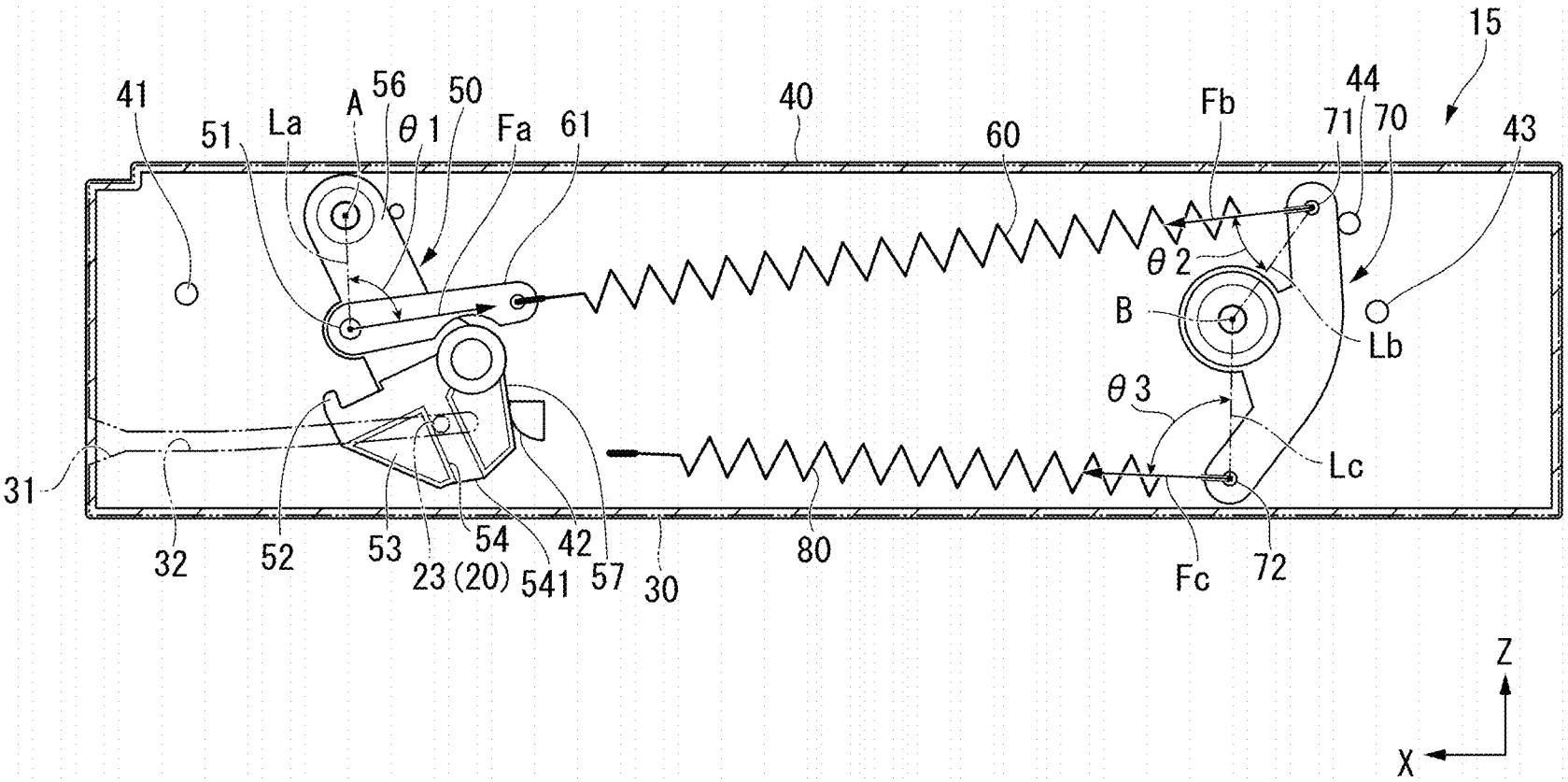
FIG. 4 is a side view illustrating the pull-in mechanism of the embodiment.

FIGS. 3 and 4 are side views illustrating the pull-in mechanism 15 of the embodiment. As illustrated in FIG. 3, the pull-in mechanism 15 includes a chassis 30, a cover 40, a pull-in member 50, a biasing member 60, an intermediate lever 70, and an auxiliary biasing member 80.

The chassis 30 has a substantial plate shape. The chassis 30 is connected to the inner side surface 10 of the apparatus main body 6 so that the front and back surfaces face the left and right directions. The chassis 30 overlaps the introduction hole 11 of the inner side surface 10 as viewed from the front (see FIG. 2).

An introduction groove 31 and a guide groove 32 are formed in the chassis 30. The introduction groove 31 is formed in the edge of the front side of the chassis 30. The interval between the edges of the introduction groove 31 is narrowed toward the back side. The guide groove 32 extends from the introduction groove 31 to the back side with a substantially constant width. The guide groove 32 extends slightly to the upside as moving toward the back side. However, the guide groove may extend parallel to the depth direction.

The cover 40 has a substantial box shape with an opening. The cover 40 is open toward the right. The cover 40 is bonded to the chassis 30 by aligning an opening edge of the cover 40 with the edge of the chassis 30. The cover 40 includes a locking portion 41, a first contacting portion 42, a second contacting portion 43, and a third contacting portion 44 inside the cover 40. The locking portion 41 has a cylindrical shape whose axis is along the left-right direction. The pull-in member 50 is in contact with the first contacting portion 42. The intermediate lever 70 is in contact with the second contacting portion 43 and the third contacting portion 44.

The pull-in member 50 is inside the cover 40. The pull-in member 50 is provided to be rotatable around a first axis line A along the left-right direction with respect to the apparatus main body 6. The first axis line A is above the guide groove 32. The pull-in member 50 is rotatable in both directions around the first axis line A between the pull-in start position illustrated in FIG. 3 and the pull-in complete position illustrated in FIG. 4. With respect to the peripheral direction around the first axis line A, the direction in which the pull-in member 50 rotates from the pull-in start position toward the pull-in complete position is defined as a first rotational direction. The direction opposite to the first rotational direction is defined as a second rotational direction. The pull-in member 50 is in contact with the first contacting portion 42 at the pull-in complete position. By allowing the pull-in member 50 to be in contact with the first contacting portion 42, the pull-in member 50 is restricted from further rotating in the first rotational direction from the pull-in complete position.

In the following description of the pull-in member 50, unless otherwise specified, the state in which the pull-in member 50 is at the pull-in start position will be described. The pull-in member 50 includes a first connecting portion 51 and a hook 52 at a position far from the first axis line A as viewed from the left-right direction. The biasing member 60 is connected to the first connecting portion 51 via a link member 61. The link member 61 is rotatably supported on the pull-in member 50. The biasing force of the biasing member 60 is exerted on the first connecting portion 51. The position of the first connecting portion 51 is set so that a vector Fa of the biasing force of the biasing member 60 exerted on the first connecting portion 51 always passes through the side closer to the guide groove 32 than the first axis line A. In the embodiment, the first connecting portion 51 is below the first axis line A. The hook 52 is detachably locked to the locking portion 41 of the cover 40.

The pull-in member 50 has a side surface 53 facing the chassis 30. The side surface 53 is directed to the right side. An engaging groove 54 is formed on the side surface 53. The engaging groove 54 includes a first end portion 541 at a position overlapping the guide groove 32 as viewed from the left-right direction. The first end portion 541 is open to the front side. The first end portion 541 is located on the side closer to the introduction groove 31 of the chassis 30 than the first axis line A. The engaging groove 54 extends from the first end portion 541 toward the first axis line A. The engaging groove 54 extends with a substantially constant width.

In the embodiment, the pull-in member 50 includes a base portion 56 and a floating portion 57. The base portion 56 is rotatable around the first axis line A and is non-displaceable with respect to the first axis line A. The base portion 56 includes the first connecting portion 51. The floating portion 57 is located at a position apart from the first axis line A. The floating portion 57 is provided to be rotatable around an axis line along the left-right direction with respect to the base portion 56. The rotational axis of the floating portion 57 is above the guide groove 32. The floating portion 57 includes the engaging groove 54 and the hook 52. The engaging groove 54 is on the side closer to the introduction groove 31 than the rotational axis of the floating portion 57. The floating portion 57 is biased in the same direction as the second rotational direction as viewed from the left-right direction. At the position with respect to the base portion 56 illustrated in FIG. 3, the floating portion 57 is restricted from rotating in the same direction as the second rotational direction as viewed from the left-right direction and is permitted to rotate in the same direction as the first rotational direction.

The intermediate lever 70 is located inside the cover 40. The intermediate lever 70 is on the back side of the pull-in member 50. The intermediate lever 70 is provided to be rotatable around a second axis line B along the left-right direction with respect to the apparatus main body 6. The intermediate lever 70 includes a second connecting portion 71 and a third connecting portion 72. The biasing member 60 is connected to the second connecting portion 71. An auxiliary biasing member 80 is connected to the third connecting portion 72. The second connecting portion 71 and the third connecting portion 72 are in a positional relationship in which the moment by the biasing force of the biasing member 60 and the moment by the biasing force of the auxiliary biasing member 80 are opposite to each other. In the illustrated example, the second connecting portion 71 is above the second axis line B. In the illustrated example, the third connecting portion 72 is below the second axis line B. With respect to the peripheral direction around the second axis line B, the direction in which the second connecting portion 71 rotates toward the front side is defined as a third rotational direction, and the direction opposite to the third rotational direction is defined as a fourth rotational direction. The intermediate lever 70 is in contact with the second contacting portion 43 in the state where the pull-in member 50 is at the pull-in start position. By allowing the intermediate lever 70 to be in contact with the second contacting portion 43, the intermediate lever 70 is restricted from rotating in the third rotational direction. The intermediate lever 70 is in contact with the third contacting portion 44 in the state where the pull-in member 50 is at the pull-in complete position. By allowing the intermediate lever 70 to in contact with the third contacting portion 44, the intermediate lever 70 is restricted from rotating in the fourth rotational direction.

The biasing member 60 is inside the cover 40. The biasing member 60 is a tension coil spring. The biasing member 60 biases the first connecting portion 51 of the pull-in member 50 and the second connecting portion 71 of the intermediate lever 70 to approach each other. The biasing member 60 is connected to the first connecting portion 51 via the link member 61. The biasing member 60 biases the base portion 56 of the pull-in member 50 toward the back side to apply a torque in the first rotational direction to the base portion 56. The biasing member 60 biases the second connecting portion 71 toward the front side. The biasing member 60 applies torque in the third rotational direction to the intermediate lever 70.

As viewed from the left-right direction, the angle formed by the direction of the biasing force of the biasing member 60 exerted on the pull-in member 50 and a line segment La passing through the first axis line A and the first connecting portion 51 is defined as θ1. The θ1 is an angle formed by the vector Fa of the biasing force of the biasing member 60 exerted on the first connecting portion 51 and the vector directed from the first connecting portion 51 toward the first axis line A. The θ1 is increased as the pull-in member 50 moves from the pull-in start position toward the pull-in complete position. The θ1 is an acute angle in all states where the pull-in member 50 is between the pull-in start position and the pull-in complete position. The state in which the pull-in member 50 is between the pull-in start position and the pull-in complete position includes states in which the pull-in member 50 is at the pull-in start position and the pull-in complete position, respectively.

As viewed from the left-right direction, the angle formed by the direction of the biasing force of the biasing member 60 exerted on the intermediate lever 70 and a line segment Lb passing through the second axis line B and the second connecting portion 71 is defined as θ2. The θ2 is an angle formed by a vector Fb of the biasing force of the biasing member 60 exerted on the second connecting portion 71 and a vector directed from the second connecting portion 71 toward the second axis line B. The θ2 is decreased as the pull-in member 50 moves from the pull-in start position toward the pull-in complete position. The θ2 is an obtuse angle in the state where the pull-in member 50 is at the pull-in start position. The θ2 is an acute angle in the state where the pull-in member 50 is at the pull-in complete position.

The auxiliary biasing member 80 is inside the cover 40. The auxiliary biasing member 80 is a tension coil spring. The auxiliary biasing member 80 is connected to the third connecting portion 72 of the intermediate lever 70 and the cover 40. The auxiliary biasing member 80 biases the third connecting portion 72 toward the front side with respect to the cover 40. The auxiliary biasing member 80 applies torque in the fourth rotational direction to the intermediate lever 70.

As viewed from the left-right direction, the angle formed by the direction of the biasing force of the auxiliary biasing member 80 exerted on the intermediate lever 70 and a line segment Lc passing through the second axis line B and the third connecting portion 72 is defined as θ3. The θ3 is an angle formed by a vector Fc of the biasing force of the auxiliary biasing member 80 exerted on the third connecting portion 72 and the vector directed from the third connecting portion 72 toward the second axis line B. The θ3 is increased as the pull-in member 50 moves from the pull-in start position toward the pull-in complete position. The θ3 is an acute angle in all states where the pull-in member 50 is between the pull-in start position and the pull-in complete position.

The sheet feed cassette 20 illustrated in FIG. 2 is inserted into the apparatus main body 6. The insertion direction of the sheet feed cassette 20 into the apparatus main body 6 is along the back side. The sheet feed cassette 20 is displaced in both directions along the depth direction between the pull-out position where the sheet feed cassette 20 is pulled out from the apparatus main body 6 toward the front side and the insertion position where the sheet feed cassette 20 is completely inserted into the apparatus main body 6 on the back side. The sheet feed cassette 20 is formed in a box shape that opens upward with the mounting surface 21 as the bottom surface. A plurality of sheets are stacked on the mounting surface 21 in the vertical direction. The sheet feed cassette 20 retains a stack of sheets having a stacking height equal to or lower than the maximum stacking height.

The sheet feed cassette 20 includes a pull-in end 22 and a guided pin 23. The pull-in end 22 is arranged in the end portion of the back side of the sheet feed cassette 20. When the sheet feed cassette 20 is inserted into the apparatus main body 6, the pull-in end 22 passes through the introduction hole 11 on the inner side surface 10 of the apparatus main body 6. The pull-in end 22 is along the right side surface of the chassis 30 of the pull-in mechanism 15 on the back side of the inner side surface 10.

The guided pin 23 protrudes from the pull-in end 22. The guided pin 23 has a length in the left-right direction. For example, the guided pin 23 has a columnar shape with a central axis along the left-right direction. The guided pin 23 protrudes to the left side from the pull-in end 22. The guided pin 23 passes through the introduction groove 31 and the guide groove 32 of the chassis 30 when the sheet feed cassette 20 is inserted into the apparatus main body 6.

The operation of the pull-in mechanism 15 when the sheet feed cassette 20 is inserted into and removed from the apparatus main body 6 will be described with reference to FIGS. 3 and 4.

When the sheet feed cassette 20 is inserted into the apparatus main body 6, the pull-in end 22 passes through the introduction hole 11 of the inner side surface 10. The guided pin 23 passes through the introduction groove 31 of the chassis 30 of the pull-in mechanism 15 to be introduced into the guide groove 32. When the guided pin 23 enters the back side along the guide groove 32, the tip of the guided pin 23 enters the engaging groove 54 of the pull-in member 50. FIG. 3 illustrates an initial state in which the sheet feed cassette 20 is inserted into the apparatus main body 6 and the guided pin 23 and the pull-in member 50 are in contact with each other.

When the sheet feed cassette 20 is further inserted into the back side, the guided pin 23 pushes the pull-in member 50 to the back side in the engaging groove 54. When the pull-in member 50 is pushed to the back side, the engagement between the locking portion 41 and the hook 52 is released. In the embodiment, when the guided pin 23 pushes the floating portion 57 of the pull-in member 50 to the back side, the floating portion 57 rotates with respect to the base portion 56, and the engagement between the locking portion 41 and the hook 52 is released.

When the engagement between the locking portion 41 and the hook 52 is released, torque in the first rotational direction is applied from the biasing member 60 to the pull-in member 50. The pull-in member 50 starts to rotate in the first rotational direction from the pull-in start position toward the pull-in complete position. When the pull-in member 50 rotates in the first rotational direction, the pull-in member 50 presses the guided pin 23 of the sheet feed cassette 20 to the back side on the side surface of the engaging groove 54. The guided pin 23 enters the back side along the guide groove 32 by the pressing force applied from the pull-in member 50. The guided pin 23 passes below the first axis line A in the process of entering the back side along the guide groove 32. The sheet feed cassette 20 is inserted into the apparatus main body 6 along with the displacement of the guided pin 23 toward the back side. When the pull-in member 50 reaches the pull-in complete position, the rotation of the pull-in member 50 is stopped. The sheet feed cassette 20 is in the state where the sheet feed cassette 20 is completely inserted into the apparatus main body 6.

When the pull-in member 50 rotates in the first rotational direction from the pull-in start position, the first connecting portion 51 is displaced to the back side. The second connecting portion 71 of the intermediate lever 70 is connected to the first connecting portion 51 via the biasing member 60. When the first connecting portion 51 is displaced to the back side, the second connecting portion 71 of the intermediate lever 70 is also displaced to the back side, and the intermediate lever 70 rotates in the fourth rotational direction. When the intermediate lever 70 rotates in the fourth rotational direction, the third connecting portion 72 is displaced toward the front side, and the auxiliary biasing member 80 is contracted. Since the θ3 is increased at an acute angle in the process of contracting the auxiliary biasing member 80, the torque applied to the intermediate lever 70 by the auxiliary biasing member 80 in the fourth rotational direction is also increased.

The torque applied to the intermediate lever 70 by the biasing member 60 is increased in order to balance the torque applied to the intermediate lever 70 by the auxiliary biasing member 80. In order to increase the torque applied to the intermediate lever 70, at least when the θ2 is an acute angle, the biasing member 60 gradually extends. In the embodiment, even when the θ2 is an obtuse angle, the biasing member 60 gradually extends. By allowing the biasing member 60 to gradually extend, the biasing force of the biasing member 60 is increased as the pull-in member 50 moves from the pull-in start position toward the pull-in complete position.

The θ1 becomes large in the process of the pull-in member 50 moving from the pull-in start position toward the pull-in complete position. At least when the θ1 is an acute angle, the torque applied to the pull-in member 50 by the biasing member 60 is increased. In the embodiment, since the θ1 is always an acute angle, the torque applied to the pull-in member 50 by the biasing member 60 is gradually increased in the entire process of the pull-in member 50 moving from the pull-in start position toward the pull-in complete position. As a result, the force with which the pull-in member 50 presses the sheet feed cassette 20 to the back side is always increased as the pull-in member 50 moves from the pull-in start position toward the pull-in complete position.

When the sheet feed cassette 20 is pulled out from the apparatus main body 6, the pull-in member 50 is pushed toward the front side by the guided pin 23 in the engaging groove 54 and rotates in the second rotational direction. The force with which the pull-in member 50 presses the sheet feed cassette 20 to the back side is always decreased as the pull-in member 50 moves from the pull-in complete position toward the pull-in start position. When the pull-in member 50 reaches the pull-in start position, the guided pin 23 is retracted from the engaging groove 54 and the hook 52 is engaged with the locking portion 41 of the cover 40. By allowing the hook 52 to be engaged with the locking portion 41 of the cover 40, the pull-in member 50 is retained at the pull-in start position.

The first position and the second position of the pull-in member 50 are defined as follows. The first position is a position closer to the pull-in complete position than the pull-in start position. The second position is a position closer to the pull-in start position than the first position. With the pull-in mechanism 15 formed as described above, the pull-in mechanism 15 satisfies the following conditions. The biasing force of the biasing member 60 in the state where the pull-in member 50 is at the first position is larger than the biasing force of the biasing member 60 in the state where the pull-in member 50 is at the second position. The force with which the pull-in member 50 presses the sheet feed cassette 20 at the first position is larger than the force with which the pull-in member 50 presses the sheet feed cassette 20 at the second position. The first position and the second position are not particularly limited, but in the embodiment, the first position includes the pull-in complete position, and the second position includes the pull-in start position.

The image processing apparatus 1 according to the embodiment includes the pull-in member 50 that pulls the sheet feed cassette 20 into the apparatus main body 6 and the biasing member 60 that biases the pull-in member 50 to the back side. The biasing force of the biasing member 60 exerted on the pull-in member 50 at the first position is larger than the biasing force of the biasing member 60 exerted on the pull-in member 50 at the second position. The first position is closer to the pull-in complete position than the pull-in start position. The second position is closer to the pull-in start position than the first position. For this reason, the force with which the pull-in member 50 presses the sheet feed cassette 20 to the back side can be relatively small in the state where the pull-in member 50 is at the second position closer to the pull-in start position than at the first position. As compared with the configuration in which the biasing force of the biasing member is increased as the pull-in member moves from the pull-in complete position toward the pull-in start position, the load applied on the operator when the sheet feed cassette 20 is pulled out can be decreased. In addition, even when the load applied to the pull-in member 50 is larger in the first position than in the second position, the pull-in member 50 can be allowed to pass through the first position. Therefore, it is possible to decrease the load when the sheet feed cassette 20 is pulled out and it is possible to automatically and reliably pull in the sheet feed cassette 20 to the apparatus main body.

The first position includes the pull-in complete position. For this reason, even when the load applied to the sheet feed cassette 20 is larger at the pull-in complete position than at the second position, it is possible to allow the pull-in member 50 to reliably reach the pull-in complete position. Therefore, the sheet feed cassette 20 can be reliably pulled in to the innermost insertion position by pressing the pull-in member 50.

The biasing force of the biasing member 60 exerted on the pull-in member 50 is increased as the pull-in member 50 moves from the pull-in start position toward the pull-in complete position. For this reason, the torque applied to the pull-in member 50 by the biasing member 60 can be increased as the pull-in member 50 moves from the pull-in start position toward the pull-in complete position. For this reason, even when the load exerted on the sheet feed cassette 20 is increased as the pull-in member 50 moves from the pull-in start position toward the pull-in complete position, it is possible to pull in the sheet feed cassette 20 to the innermost side.

The force with which the pull-in member 50 presses the sheet feed cassette 20 at the first position is larger than the force with which the pull-in member 50 presses the sheet feed cassette 20 at the second position. For this reason, even when the load applied to the sheet feed cassette 20 is larger at the first position than at the second position, the sheet feed cassette 20 can be passed through the first position by pressing the pull-in member 50.

The first position includes the pull-in complete position. For this reason, even when the load applied to the sheet feed cassette 20 is larger at the pull-in complete position than at the second position, the sheet feed cassette 20 can be reliably pulled in to the innermost insertion position by the pull-in member 50.

In general, in some cases, a mechanism for detecting the sheet stored in the sheet feed cassette, a mechanism for allowing the sheet feed roller to approach the sheet feed cassette and be separated from the sheet feed cassette, and the like are provided to the image forming apparatus. In this case, various mechanisms are driven by the operation of allowing the sheet feed cassette to be inserted into the apparatus main body. As a result, the load applied on the sheet feed cassette is increased as the sheet feed cassette approaches the pull-in complete position. The force of pressing the sheet feed cassette needs to exceed the load when the sheet feed cassette approaches the pull-in complete position. When the sheet feed cassette is pressed by the biasing force of a single coil spring, the coil spring approaches a no-load state as the sheet feed cassette moves from the pull-in start position toward the pull-in complete position. For this reason, the force with which the coil spring presses the sheet feed cassette is increased as the sheet feed cassette moves from the pull-in complete position toward the pull-in start position. The pull-in force exerted on the sheet feed cassette becomes larger than necessary at the pull-in start position. When the sheet feed cassette is manually pulled out, the load is applied to the user.

Figure 5:
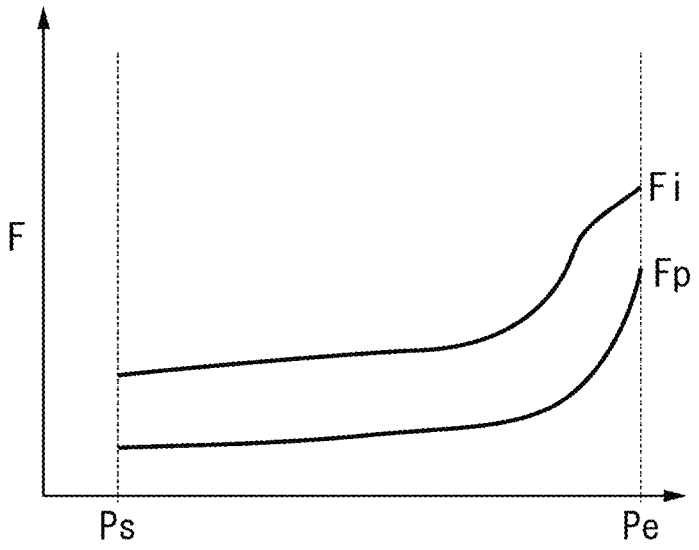
FIG. 5 is a diagram illustrating a force exerted on a sheet feed cassette of the image processing apparatus according to the embodiment.

FIG. 5 is a diagram illustrating a force exerted on the sheet feed cassette 20 of the image processing apparatus 1 according to the embodiment. In FIG. 5, the horizontal axis represents the position in the insertion direction of the sheet feed cassette 20. On the horizontal axis, the position where the guided pin 23 is engaged with the pull-in member 50 at the pull-in start position is defined as Ps. The position where the guided pin 23 is engaged with the pull-in member 50 at the pull-in complete position is defined as Pe. The vertical axis represents the magnitude of the force exerted on the sheet feed cassette 20. Fp is a force exerted on the sheet feed cassette 20 in the direction opposite to the insertion direction when the sheet feed cassette 20 is inserted. Fi is a force with which the pull-in member 50 presses the sheet feed cassette 20 in the insertion direction.

As illustrated in FIG. 5, the force with which the pull-in member 50 presses the sheet feed cassette 20 is increased as the pull-in member 50 moves from the pull-in start position toward the pull-in complete position. For this reason, even when the load exerted on the sheet feed cassette 20 is increased as the pull-in member 50 moves from the pull-in start position toward the pull-in complete position, the sheet feed cassette 20 can be pulled in to the pull-in complete position. Therefore, it is possible to decrease the load when the sheet feed cassette 20 is pulled out and it is possible to automatically and reliably pull in the sheet feed cassette 20 to the apparatus main body.

The θ1 is an acute angle in at least a portion of the state where the pull-in member 50 is between the pull-in start position and the pull-in complete position. The θ1 is increased as the pull-in member 50 moves from the pull-in start position toward the pull-in complete position. At least when the θ1 is an acute angle, the torque applied to the pull-in member 50 by the biasing member 60 can be increased as the pull-in member 50 moves from the pull-in complete position toward the pull-in start position regardless of the biasing force of the biasing member 60. Therefore, it is possible to decrease the load when the sheet feed cassette 20 is pulled out and it is possible to reliably pull in the sheet feed cassette 20 to the apparatus main body.

The image processing apparatus 1 includes the intermediate lever 70 biased against the pull-in member 50 by the biasing member 60 and the auxiliary biasing member 80 that biases the intermediate lever 70 in a direction opposite to the biasing direction by the biasing member 60. The torque applied to the intermediate lever 70 by the auxiliary biasing member 80 is increased as the pull-in member 50 moves from the pull-in start position toward the pull-in complete position. For this reason, the force exerted on the biasing member 60 from the intermediate lever 70 can be increased as the pull-in member 50 moves from the pull-in start position toward the pull-in complete position. Therefore, it is relatively easy to obtain the configuration in which the biasing force of the biasing member 60 is increased as the pull-in member 50 moves from the pull-in start position toward the pull-in complete position.

The θ2 is an acute angle in at least a portion of the state where the pull-in member 50 is between the pull-in start position and the pull-in complete position. The θ2 is decreased as the pull-in member 50 moves from the pull-in start position toward the pull-in complete position. At least when the θ2 is an acute angle, the force exerted on the biasing member 60 from the intermediate lever 70 can be increased as the pull-in member 50 moves from the pull-in start position to the pull-in complete position regardless of the biasing force of the auxiliary biasing member 80. Therefore, it is relatively easy to obtain the configuration in which the biasing force of the biasing member 60 is increased as the pull-in member 50 moves from the pull-in start position toward the pull-in complete position.

The θ3 is an acute angle in at least a portion of the state where the pull-in member 50 is between the pull-in start position and the pull-in complete position. The θ3 is increased as the pull-in member 50 moves from the pull-in start position toward the pull-in complete position. At least when the θ2 is an acute angle, the torque applied to the intermediate lever 70 by the auxiliary biasing member 80 can be increased as the pull-in member 50 moves from the pull-in start position toward the pull-in complete position regardless of the biasing force of the auxiliary biasing member 80. Accordingly, the force exerted on the biasing member 60 from the intermediate lever 70 can be increased as the pull-in member 50 moves from the pull-in start position toward the pull-in complete position. Therefore, it is relatively easy to obtain the configuration in which the biasing force of the biasing member 60 is increased as the pull-in member 50 moves from the pull-in start position toward the pull-in complete position.

In the above-described embodiment, the θ1 is always an acute angle but the embodiment is not limited to this configuration. The θ1 may have an obtuse angle in the state where the pull-in member is at the pull-in complete position. The same applies to the θ3.

In the above-described embodiment, the θ2 is an obtuse angle in the state where the pull-in member 50 is at the pull-in start position, but the embodiment is not limited to this configuration. The θ2 may always be an acute angle.

In the above-described embodiment, the pull-in member 50 is formed to be rotatable with respect to the apparatus main body 6, but the embodiment is not limited to this configuration. For example, the pull-in member may be configured so as to translate along the depth direction in the state where the pull-in member is engaged with a portion of the sheet feed cassette 20.

In the above-described embodiment, the biasing member 60 is connected to the pull-in member 50 via the link member 61, but the embodiment is not limited to this configuration. The biasing member 60 may be directly connected to the pull-in member 50. In addition, at least one of the biasing member 60 and the auxiliary biasing member 80 may be connected to the intermediate lever 70 via the link member.

In the above-described embodiment, the insertion direction of the sheet feed cassette 20 is a direction toward the back side, but the embodiment is not limited to this configuration. The image processing apparatus may be formed so that the insertion direction of the sheet feed cassette is one of the left and right directions.

According to at least one embodiment described above, it is possible to decrease the load when the sheet feed cassette 20 is pulled out and it is possible to automatically and reliably pull in the sheet feed cassette 20 to the apparatus main body.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein maybe made without departing from the spirit of the inventions. The accompanying claims and their equivalents are intended to cover such forms or modifications as would fall within the scope and spirit of the invention.

What is claimed is:

1. An image processing apparatus, comprising:

an apparatus main body;

a sheet feed cassette insertable into the apparatus main body;

a pull-in member configured to pull in the sheet feed cassette to the apparatus main body from a pull-in start position to a pull-in complete position; and a biasing member configured to bias the pull-in member in an insertion direction, wherein a biasing force in a state where the pull-in member is at a first position closer to the pull-in complete position than the pull-in start position is larger than a biasing force in a state where the pull-in member is at a second position closer to the pull-in start position than the first position, wherein a force with which the pull-in member presses the sheet feed cassette at the first position is larger than a force with which the pull-in member presses the sheet feed cassette at the second position, and the force with which the pull-in member presses the sheet feed cassette increases as the pull-in member moves from the pull-in start position toward the pull-in complete position.

2. The image processing apparatus according to claim 1, wherein the first position includes the pull-in complete position.

3. The image processing apparatus according to claim 1, wherein the biasing force of the biasing member exerted on the pull-in member increases as the pull-in member moves from the pull-in start position toward the pull-in complete position.

4. The image processing apparatus according to claim 1, wherein the first position includes the pull-in complete position.

5. The image processing apparatus according to claim 1, wherein the pull-in member comprises a first connecting portion to which the biasing member is connected, is rotatable around a first axis line along a first axis direction perpendicular to the insertion direction of the sheet feed cassette with respect to the apparatus main body, and presses the sheet feed cassette in the insertion direction by rotating in the first rotational direction from the pull-in start position to the pull-in complete position, and as viewed from the first axis direction, when an angle formed by a direction of the biasing force of the biasing member exerted on the first connecting portion and a line segment passing through the first axis line and the first connecting portion is defined as $\theta 1$, the $\theta 1$ is an acute angle in at least a portion of a state where the pull-in member is between the pull-in start position and the pull-in complete position, and the $\theta 1$ increases as the pull-in member moves from the pull-in start position toward the pull-in complete position.

6. The image processing apparatus according to claim 1, further comprising:

an intermediate lever rotatable around a second axis line along a second axis direction perpendicular to the insertion direction with respect to the apparatus main body and biased toward the pull-in member by the biasing member; and an auxiliary biasing member configured to bias the intermediate lever in a direction opposite to the biasing direction by the biasing member, wherein a torque applied to the intermediate lever by the auxiliary biasing member increases as the pull-in member moves from the pull-in start position toward the pull-in complete position.

7. The image processing apparatus according to claim 6, wherein the intermediate lever comprises a second connecting portion to which the biasing member is connected, and as viewed from the second axis direction, when an angle formed by a line segment passing through the second axis line and the second connecting portion and a direction of the biasing force of the biasing member exerted on the intermediate lever is defined as $\theta 2$, the $\theta 2$ is an acute angle in at least a portion of the state where the pull-in member is between the pull-in start position and the pull-in complete position and the $\theta 2$ decreases as the pull-in member moves from the pull-in start position toward the pull-in complete position.

8. The image processing apparatus according to claim 6, wherein the intermediate lever comprises a third connecting portion to which the auxiliary biasing member is connected, and as viewed from the second axis direction, when an angle formed by a line segment passing through the second axis line and the third connecting portion and a direction of the biasing force of the auxiliary biasing member exerted on the intermediate lever is defined as $\theta 3$, the $\theta 3$ is an acute angle in at least a portion of the state where the pull-in member is between the pull-in start position and the pull-in complete position and the $\theta 3$ increases as the pull-in member moves from the pull-in start position toward the pull-in complete position.

9. A sheet feed cassette operating mechanism, comprising:

a sheet feed cassette insertable into a main body;

a pull-in member configured to pull in the sheet feed cassette to the main body from a pull-in start position to a pull-in complete position; and a biasing member configured to bias the pull-in member in an insertion direction, wherein a biasing force in a state where the pull-in member is at a first position closer to the pull-in complete position than the pull-in start position is larger than a biasing force in a state where the pull-in member is at a second position closer to the pull-in start position than the first position, wherein the pull-in member comprises a first connecting portion to which the biasing member is connected, is rotatable around a first axis line along a first axis direction perpendicular to the insertion direction of the sheet feed cassette with respect to the main body, and presses the sheet feed cassette in the insertion direction by rotating in the first rotational direction from the pull-in start position to the pull-in complete position, and as viewed from the first axis direction, when an angle formed by a direction of the biasing force of the biasing member exerted on the first connecting portion and a line segment passing through the first axis line and the first connecting portion is defined as θ1, the θ1 is an acute angle in at least a portion of a state where the pull-in member is between the pull-in start position and the pull-in complete position, and the θ1 increases as the pull-in member moves from the pull-in start position toward the pull-in complete position.

10. The sheet feed cassette operating mechanism according to claim 9, further comprising:

an intermediate lever rotatable around a second axis line along a second axis direction perpendicular to the insertion direction with respect to the main body and biased toward the pull-in member by the biasing member; and an auxiliary biasing member configured to bias the intermediate lever in a direction opposite to the biasing direction by the biasing member, wherein a torque applied to the intermediate lever by the auxiliary biasing member increases as the pull-in member moves from the pull-in start position toward the pull-in complete position.

11. The sheet feed cassette operating mechanism according to claim 10, wherein the intermediate lever comprises a second connecting portion to which the biasing member is connected, and as viewed from the second axis direction, when an angle formed by a line segment passing through the second axis line and the second connecting portion and a direction of the biasing force of the biasing member exerted on the intermediate lever is defined as θ2, the θ2 is an acute angle in at least a portion of the state where the pull-in member is between the pull-in start position and the pull-in complete position and the θ2 decreases as the pull-in member moves from the pull-in start position toward the pull-in complete position.

12. The sheet feed cassette operating mechanism according to claim 10, wherein the intermediate lever comprises a third connecting portion to which the auxiliary biasing member is connected, and as viewed from the second axis direction, when an angle formed by a line segment passing through the second axis line and the third connecting portion and a direction of the biasing force of the auxiliary biasing member exerted on the intermediate lever is defined as θ3, the θ3 is an acute angle in at least a portion of the state where the pull-in member is between the pull-in start position and the pull-in complete position and the θ3 increases as the pull-in member moves from the pull-in start position toward the pull-in complete position.

13. The sheet feed cassette operating mechanism according to claim 9, wherein the first position includes the pull-in complete position.

14. An image processing apparatus, comprising:

an apparatus main body;

a sheet feed cassette insertable into the apparatus main body;

a pull-in member configured to pull in the sheet feed cassette to the apparatus main body from a pull-in start position to a pull-in complete position;

a biasing member configured to bias the pull-in member in an insertion direction, wherein a biasing force in a state where the pull-in member is at a first position closer to the pull-in complete position than the pull-in start position is larger than a biasing force in a state where the pull-in member is at a second position closer to the pull-in start position than the first position;

an intermediate lever rotatable around a second axis line along a second axis direction perpendicular to the insertion direction with respect to the apparatus main body and biased toward the pull-in member by the biasing member; and an auxiliary biasing member configured to bias the intermediate lever in a direction opposite to the biasing direction by the biasing member, wherein a torque applied to the intermediate lever by the auxiliary biasing member increases as the pull-in member moves from the pull-in start position toward the pull-in complete position.

15. The image processing apparatus according to claim 14, wherein the first position includes the pull-in complete position.

16. The image processing apparatus according to claim 14, wherein the biasing force of the biasing member exerted on the pull-in member increases as the pull-in member moves from the pull-in start position toward the pull-in complete position.

17. The image processing apparatus according to claim 14, wherein a force with which the pull-in member presses the sheet feed cassette at the first position is larger than a force with which the pull-in member presses the sheet feed cassette at the second position.

18. The image processing apparatus according to claim 14, wherein the pull-in member comprises a first connecting portion to which the biasing member is connected, is rotatable around a first axis line along a first axis direction perpendicular to the insertion direction of the sheet feed cassette with respect to the apparatus main body, and presses the sheet feed cassette in the insertion direction by rotating in the first rotational direction from the pull-in start position to the pull-in complete position, and as viewed from the first axis direction, when an angle formed by a direction of the biasing force of the biasing member exerted on the first connecting portion and a line segment passing through the first axis line and the first connecting portion is defined as θ1, the θ1 is an acute angle in at least a portion of a state where the pull-in member is between the pull-in start position and the pull-in complete position, and the θ1 increases as the pull-in member moves from the pull-in start position toward the pull-in complete position.

19. The image processing apparatus according to claim 14, wherein the intermediate lever comprises a second connecting portion to which the biasing member is connected, and as viewed from the second axis direction, when an angle formed by a line segment passing through the second axis line and the second connecting portion and a direction of the biasing force of the biasing member exerted on the intermediate lever is defined as θ2, the θ2 is an acute angle in at least a portion of the state where the pull-in member is between the pull-in start position and the pull-in complete position and the θ2 decreases as the pull-in member moves from the pull-in start position toward the pull-in complete position.

20. The image processing apparatus according to claim 14, wherein the intermediate lever comprises a third connecting portion to which the auxiliary biasing member is connected, and as viewed from the second axis direction, when an angle formed by a line segment passing through the second axis line and the third connecting portion and a direction of the biasing force of the auxiliary biasing member exerted on the intermediate lever is defined as θ3, the θ3 is an acute angle in at least a portion of the state where the pull-in member is between the pull-in start position and the pull-in complete position and the θ3 increases as the pull-in member moves from the pull-in start position toward the pull-in complete position.

* * * * *